United States Patent [19]

Kankaanpää

[11] 4,163,688

[45] Aug. 7, 1979

[54] APPARATUS FOR DEWATERING IN A PAPER MACHINE

[75] Inventor: Matti Kankaanpää, Espoo, Finland

[73] Assignee: Valmet Oy, Helsinki, Finland

[21] Appl. No.: 790,421

[22] Filed: Apr. 25, 1977

Related U.S. Application Data

[63] Continuation-in-part of Ser. No. 310,805, Nov. 30, 1972, abandoned.

[30] Foreign Application Priority Data

May 18, 1976 [FI] Finland ..... 761398

[51] Int. Cl.$^2$ ..... D21F 3/02

[52] U.S. Cl. ..... 162/359; 34/119; 162/206; 162/290

[58] Field of Search ..... 162/206, 207, 290, 359, 162/360 R; 34/116, 119, 123, 124

[56] References Cited

U.S. PATENT DOCUMENTS

| | | | |
|---|---|---|---|
| 2,907,690 | 10/1959 | Hornbastel et al. | 162/206 |
| 3,097,994 | 7/1963 | Dickens et al. | 162/359 X |
| 3,560,333 | 2/1971 | Douglas et al. | 162/206 |
| 3,655,507 | 4/1972 | Nykopp | 162/206 X |
| 3,850,792 | 11/1974 | Pennington | 162/290 |
| 3,861,996 | 1/1975 | Dorfel | 162/360 R |
| 4,075,056 | 2/1978 | Ely et al. | 162/360 R X |

*Primary Examiner*—Richard V. Fisher

*Attorney, Agent, or Firm*—Roylance, Abrams, Berdo & Farley

[57] ABSTRACT

Dewatering of a paper web is enhanced by steam treatment in the press section of a papermaking machine wherein the web is continuously passed around a substantial sector of a suction roll between two nips formed with the suction roll by a water-receiving roll and a plain roll. A steam box is mounted adjacent the web between the nips to subject the web to treatment steam in that sector. The steam can be saturated or superheated.

3 Claims, 9 Drawing Figures

APPARATUS FOR DEWATERING IN A PAPER MACHINE

This application is a continuation-in-part of application Ser. No. 310,805, filed Nov. 30, 1972, now abandoned.

This invention relates to procedures for improvements of the dewatering process in the press section of a papermaking machine of the type wherein the paper web is passed between two nips around a suction roll, the nips being formed with the suction roll by a water-receiving roll and a plain roll.

BACKGROUND OF THE INVENTION

The invention disclosed herein is intended to be an improvement to a system of the type described in Applicant's Finnish publication No. 50,651, of which U.S. patent application Ser. No. 310,805, filed Nov. 30, 1972, now abandoned, is a counterpart. This system, which is known and will be referred to herein as the "Sym-Press" press section, includes a closed transfer press section which is a development which has been substantially responsible for recent increases in the operating speeds of paper machines. A reason for this is that, in addition to efficient dewatering, the Sym-Press section has the further advantage that web breaks are virtually eliminated.

However, in the practice of further raising paper machine speeds, the free runs of the web following after the press section have now become a bottleneck, the free runs or open draws referred to carrying the web either from the press section to the drying section or through the first free interstices in the drying section. Attempts have been made to avoid the web breaks at these points, and to avoid the consequent shutdowns of equipment by various techniques including by means of the expedients taught in Finnish Pat. No. 45,558 corresponding to U.S. Pat. No. 4,075,768; and Finnish patent applications No. 3720/74 and No. 761114, both corresponding to U.S. Pat. No. 4,016,032. While these techniques have resulted in improvements, they have not completely eliminated web breaks occurring after the press section, which breaks have harmful effects on run ability of the paper machine.

Accordingly, a primary object of the present invention is to provide a method and apparatus by which the running speed and reliability of a paper machine can be improved by enhancing the dewatering action in the press section so that the web leaves the press section having a higher dryness and higher strength than in previous devices.

It is appropriate to observe in this connection that the object of the invention is not so much to achieve in paper machines the optimum condition as regards heat economy, but rather to optimize the operation economy of the paper machine in view of its running efficiency and reliability in operation.

It is a well-known physical fact that the viscosity of water considerably decreases with increasing temperature of the water. This phenomenon has been utilized in paper machines in order to enhance the dewatering of the paper web. As examples of these prior art approaches, reference is made to previously issued U.S. Pat. Nos. 2,907,690; 3,097,994; 3,560,333; and 3,655,507. Of these, the first mentioned U.S. Pat. No. 2,907,690 discloses a normal paper machine press wherein a hot gas jet is directed from nozzles with small holes against the felt on the suction roll prior to the press nip, the intention being to lower the viscosity of the water residing in the felt and thereby to enhance the dewatering action.

The U.S. Pat. No. 3,097,994 also mentioned above discloses the use of steam supplying means in various parts of the paper machine and the means in question consists of a steam feeder box and a suction box opposed thereto. As regards the use of this particular design in the aid of enhanced dewatering in a press nip, the drawback to be observed is that the steam-supplying means has been placed rather a long distance before the conventional suction press nip, with the result that the web cools before it reaches the nip.

In the U.S. Pat. No. 3,560,333, there is disclosed means for the supplying of steam into the throat between the well-known Yankee cylinder and the suction roll opposing it, the aim being to prevent the cooling of Yankee cylinder at the press nips.

In the U.S. Pat. No. 3,655,507, a press nip with two felts is shown wherein pressurized steam-supplying means is provided inside one of the two rolls, the steam heating the felt for enhanced dewatering action in the subsequent nip.

The means for enhancement of dewatering which are based on the raising of the temperature of felt, web and/or roll have not gained very extensive application, particularly not in fast paper machines. This is partially due to the fact that it has not been possible, using the means of the prior art, to conduct to the points of supply a sufficiently high heat flow. This, again, is caused by the fact that, for example, to avoid destruction of the felt, the temperature of the treatment gas is limited and also because the available time is short because of the high web and felt speed, and further on account of space consideration, the heat transfer surface is also quite restricted. An aim of the present invention is to provide a solution to the problems presented.

Briefly described, the invention includes a process of enhancing the dewatering of a paper web in the press section of a paper machine of the type having at least two press nips through which the web consecutively passes, the first one of the nips being formed between a water-receiving roll and a suction roll and a subsequent one of the nips, in the direction of web travel, being defined by the suction roll and a plain roll, and wherein the web runs on the suction roll between the nips, the improvement comprising the step of treating the web by exposing the outer surface thereof to hot steam between the two nips so that a significant proportion of the treatment steam condenses thereon, thereby imparting the latent heat of the steam to the web.

The invention also includes apparatus for accomplishing this method in a machine of the type described and includes steam supply means mounted adjacent the web and means for conducting steam to the supply means, the supply means comprising at least one steam supply box extending across the entire width of the web adjacent the suction roll, the box having an interior space and an open side opening toward the suction roll and conforming to the curvature of the roll over a substantial sector thereof to define a flow path for treatment steam onto the sector.

Since according to the invention hot steam is used to raise the temperature of the web, the steam will in its condensation process release and impart to the web its considerable latent heat, in the order of 2,270 kilojoules per kilogram (kJ/kg). When, furthermore, the point where the steam is supplied is located as taught by the invention, the supply surface can be made rather large and the steam can be induced to penetrate immediately into the web which is being treated and also partly into the felt lying thereunder quite efficiently, also utilizing the vacuum zone at this part of the suction roll of the press. It is a further advantage of the invention that, exactly at the point of supply specified in the invention, adequate space exists for expedient steam supply means. It is also an advantage that when according to the invention the point of steam supply is placed after the first nip, then the web has had time when entering that nip, which is advantageously formed between two felts and in which the web is efficiently dewatered in two directions, to attain a dry matter content (in the order of 20 to 35%) such that one need not heat unnecessarily by the steam supply such water which is even otherwise easy to remove from the web.

In order that the manner in which the foregoing and other objects are attained in accordance with the invention can be understood in detail, particularly advantageous embodiments thereof will be described with reference to the accompanying drawings, which form a part of this specification and wherein.

Figure 1:
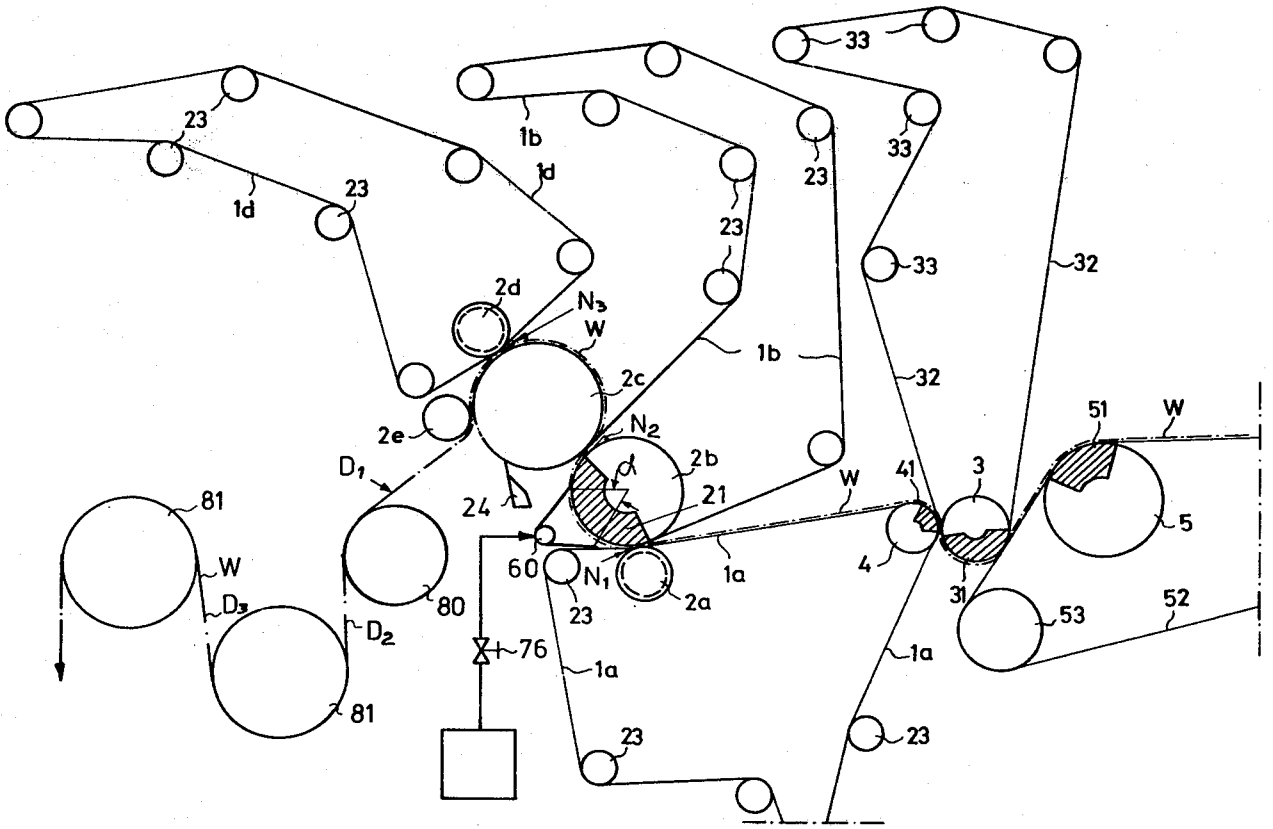
FIG. 1 is a schematic diagram of a paper machine including the press section wherein the method and apparatus of the present invention are applied.

The construction and operation of the paper machine will be understood by reference to FIG. 1 which shows a paper web W which is detached from the wire 52 between rolls 5 and 53 with the aid of a pickup roll 3 which operates within a felt loop 32 of its own. Web W remains adherent to felt 32 as a result of the effect of suction acting within roll 3. This suction zone is indicated by reference numeral 31. The web travels around roll 3 through an arc distance of about 150° after leaving the wire and then is engaged by a transfer suction roll 4 which operates within the loop of its own felt 1*a*. The suction zone of transfer roll 4 is indicated at 41. At the nip between rolls 3 and 4, the web is transferred from felt 32 to felt 1*a*.

After the web has been transferred onto felt 1*a*, this felt transports the web W to the first dewatering nip $N_1$ of the press assembly, which nip is defined by the rolls 2*a* and 2*b* and the web is pressed between two felts 1*a* and 1*b*. Roll 2*a* is a water-receiving roll or a recessed surface roll such as, for example, a grooved roll and roll 2*b* is a suction roll having either a continuous suction zone 21 or several suction compartments. Adherent to the surface of felt 1*b*, the web passes onto the following dewatering nip $N_2$ which is defined by the juxtaposition of rolls 2*b* and 2*c*. Roll 2*c* is a plain (smooth surface) roll and has no felt, whereby the dewatering in nip $N_2$ takes place in the direction toward the suction roll 2*b*. In the nip $N_2$, the web W is transferred from felt 1*b* onto roll 2*c* which carries it into the following nip $N_3$ of the press system where the roll 2*d* is a recessed surface roll and is provided with a felt 1*d* of its own.

From nip $N_3$, the web may be conventionally conducted to the drying section. However, it is also possible to place additional nips against roll 2*c*. These may be either provided with felt, if desired to attain an enhanced dewatering effect, or without felt merely to obtain a smoothing effect, such as, for example, the roll 2*e*, which has been provided with a soft covering.

The felts of the system presented in the figures have been indicated with reference numerals 1*a*, 1*b*, 1*d* and 32, and the felt guiding rolls have been identified as 23 and 33, respectively. The suction zones of different rolls carry the reference numerals 21, 31, 41 and 51, and the cleaning doctor device of the roll 2*c* is denoted as 24.

In FIG. 1, the first two drying cylinders 81 of the drying section of the paper machine and the so-called lead-in cylinder 80 have been depicted. The breaks previously referred to which occur at the first open draws indicated at $D_1$, $D_2$, $D_3$, etc. of the web W are those the elimination of which is the object of the process and apparatus of the invention.

Figure 2:
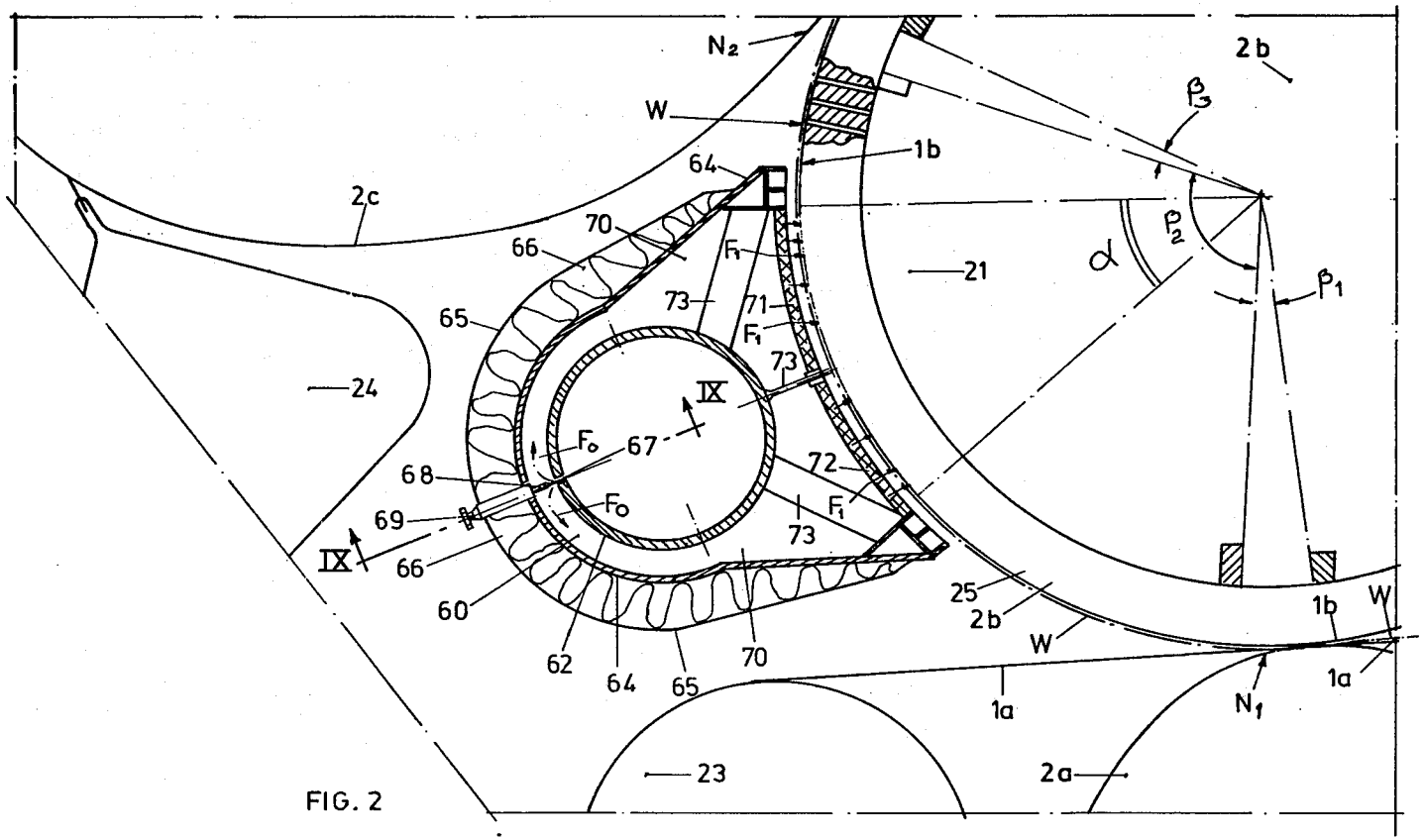
FIG. 2 is an enlarged side elevation of the press section of the apparatus of FIG. 1, in partial section, showing the arrangement of the present invention.
Figure 9:
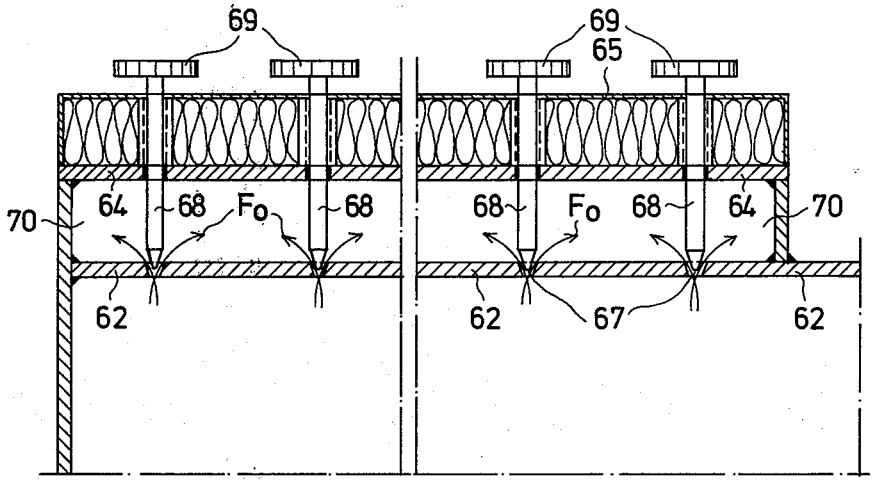
FIG. 9 is a sectional view along line IX—IX of FIG. 2.

As shown in FIGS. 1 and 2, a steam supply box 60 in accordance with the invention is mounted in association with the suction sector 21 of suction roll 2*b* in a four-roll, closed transfer, press section, the supply section of this box facing against the outer surface of web W traveling upon the felt 1*b* over the suction zone 21, which surface is freely exposed at this point. The details of the design of the steam supply box 60 are seen in FIGS. 2 and 9. The supply surface of steam supply box 60 corresponding to the central angle $\alpha$ of the suction roll lies within the holding section $\beta_2$ of the suction roll 2*b*. At the first nip $N_1$ of the press, there is a dewatering suction sector $\beta_1$, and at the second nip $N_2$, there is another dewatering suction sector $\beta_3$. The shell 25 of the suction roll 2*b* is perforated in a manner which is, in itself, previously known. In this particular suction roll, the sectors $\beta_1$ and $\beta_3$ are connected to higher vacuum than the sector $\beta_2$.

Figure 3:
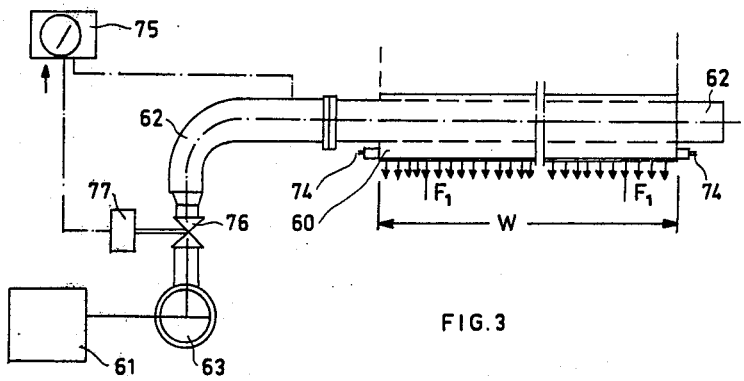
FIG. 3 is a schematic plan view of the apparatus in accordance with the present invention.

The steam supply box comprises a steam supply pipe 62 which lies within the supply box, the pipe being connected in the manner more clearly shown in FIG. 3 through a steam supply valve 76 to a steam distribution header 63 to which the steam arrives from equipment schematically represented by block 61, which equipment is a conventional component in a paper machine. In connection with the pipe 62, control means 75 is provided to control actuating motor 77 of the steam flow control valve 76. In the manner schematically shown in FIG. 3, on the lateral margins of steam supply box 60, there is provided a suction means 74 which acts to prevent the harmful discharge of steam to the sides from the margins of box 60.

As shown in FIGS. 2 and 9, supply pipe 62 of the steam supply box 60 serves as the supporting structure for the box. Side beams and a shell plate 64 are attached to the steam supply pipes 62 by supporting members 73. The steam supply pipe 62 and the shell plate 64 define within themselves a steam supply space 70 into which the steam is supplied from pipe 62 through nozzle holes 67. In connection with nozzles holes 67, which are mutually longitudinally spaced along the entire length of pipe 62, there are steam flow control spindles 68 which can be adjusted by means of control screws 69. The steam supply holes 67 are suitably spaced at greater distances from each other near the end portions of the box in order to reduce steam leakage. Steam supply box 60 comprises an outer shell 65 and thermal insulation 66 between the inner and outer shells.

The supply surface of steam supply box 60 adjacent the free outer surface of web W comprises a curved plate including plate portions 71 and 72. The curved plate can consist, for example, of a sintered material or a material which is perforated such that the steam can pass through it and act upon web W. It is possible under some circumstances to eliminate the plate including portions 71 and 72, in which case the interior space 70 of the the steam supply box can simply open toward the web. In order to distribute the steam as uniformly as possible in the interior space of the supply box and thence onward, and in order to prevent destruction of the surface of web W, the steam supply apertures 67 open in the direction opposite the supply plate portions 71 and 72, whereby the steam jets Fo have time to lose velocity and to become equalized in the space 70 before they discharge through the plate in the form of flows $F_1$ onto web W.

Referring to the press part construction shown in FIG. 1, it is particularly important in the invention that the steam supply box 60 has been located, with reference to the direction of movement of the web, after the first nip $N_1$ and before the second nip $N_2$ at the point where the web W upon felt **1*b* passes over the holding sector $\beta_2$ of suction roll 2*b*. Most advantageously, the steam supply box is placed after such a nip wherein the dry matter content of the web is between 20 and 35%, preferably about 30%. The temperature of the wet web W is raised with the aid of the steam discharging from the steam supply box 60 by exposing it from the direction of its outer surface on a sector $\alpha$ of considerable magnitude of the suction roll 1*b* to the effect of hot steam so that a remarkable and significant portion of the treatment steam condenses expressly in the web W, thereby releasing its latent heat and, in this manner, increasing the temperature of the web W and reducing the viscosity of the water, thereby enhancing the dewatering in the subsequent nip $N_2$ and, if provided, also in the nips following $N_2$. Condensation of steam may also take place into the felt 1*b*, and part of the steam flow may pass through the felt 1*b* into the suction chamber of roll 2*b***.

Most advantageously, the treatment steam is substantially at atmospheric pressure in the interior space 70 of supply box 60, owing to the loss of pressure caused by the nozzle holes 67, so that the flow of steam into the web W and through it, and partly possibly also through the felt **1*b*, being mainly accomplished as a result of the effect of the vacuum of the suction zone $\beta_2$ of the suction roll 2*b***.

In addition to the effects described, the invention causes as an extra effect that the felt loop during its continuous run through the steam treatment achieves an elevated temperature and passes through the preceding nip $N_1$, in this way enhancing the dewatering in the nip $N_1$.

According to the invention, the treatment steam is saturated steam, but it is also possible to use somewhat superheated steam although due consideration must be given to the thermal tolerance of the web W and above all of the felt **1*b* thereunder. By using the apparatus of the invention, the steam can be discharged uniformly over an extensive area onto web W and, since the steam is substantially at atmospheric pressure in the interior space 70 of the steam supply box 60**, it is not necessary to dimension the steam supply box like a pressure vessel. Thus, the construction is relatively simply and inexpensive in this regard.

The method and apparatus of the invention are in no way confined to the details presented in the foregoing which are merely by way of illustration. For example, the steam supply box 60 may be arranged to be adjustable as to its position, for example, by suspending it from articulated arms, not shown. By means of the suspension of the steam supply box 60 from articulated arms, the elastic suspension of box 60 may also be advantageously accomplished so that "lumps" of the web W cause no major damage. The spring arrangement may in this connection be realized, for example, by utilizing air cylinders. It is also possible to use a supply surface of the steam supply box 60 which is larger or smaller than that shown in the figure, and the extent of the surface which corresponds to an angle of the suction roll may be increased up to about 90°. The lower limit of sector $\alpha$ is determined by the need of enhancement of the dewatering action. The invention may furthermore be carried out so that, instead of using one steam supply box 60, two or more steam supply boxes mounted one after the other can be used, the interaction of these being adjusted so that the desired end result is obtained.

The provision of steam supply box 60 may also partly be employed to assist the keeping of the web W on the sector **2*b* of the suction box (in cooperation with the suction sector $\beta_2$) even at high speeds of the web W which speeds produce at this point rather high centrifugal forces which tend to lift the web off the surface of the roll 2*b*. In such a case, it may be desirable to use a pressure higher than atmospheric pressure in box 60** to assist in this function.

The general observation may be made that the size and placement of the steam supply box 60, or a plurality of such boxes, is determined, considering the dry matter content of web W, by space considerations, and according to the invention one may advantageously use the web surface which remains free in the "Sym-Press" press section on the suction roll **2*b*** at a point which is suitable in all respects.

Figure 6:
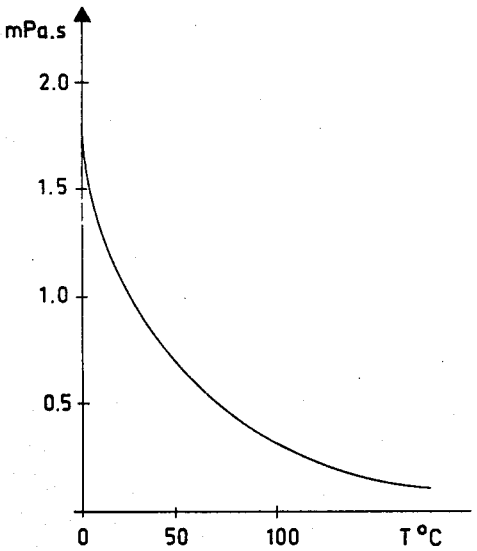
FIG. 6 is a graph illustrating the viscosity of water as a function of temperature.

It was observed above that the dewatering is enhanced through the fact that the web and the water present therein are heated such that the viscosity of the water decreases in the manner seen in the graph of FIG. 6. The effect of the method of the invention may partly also be based on the circumstance that when the steam discharges into the comparatively cold web W, there occurs the so-called implosion phenomenon, a very abrupt collapse of steam bubbles, which on the basis of mechanical effects reduces the adhesion forces acting between the fibers of the web W and the water present therein, and which thereby facilitates the escape of the water web W. Thus, as the steam flows through the water-containing fiber network, it produces as it condenses in the water films between fibers, an effect breaking up these films and thus promoting the dewatering process.

The introduction of the procedure and apparatus of the invention is partly rendered possible by the felts which have only recently appeared on the market and which tolerate comparatively high temperatures.

In order to clarify the physical background of the invention, the heating of wet paper with the aid of steam will be considered in the following discussion with reference to FIG. 4.

Let us assume, to begin with, that the steam coming from the box 60 all condenses in the web W, whereby the temperature of the web rises from $T_1$ to $T_2$. The heat losses to the environment are disregarded. The water quantity removed by the second nip $N_2$ is denoted as $\Delta V$, the water removed at this point having the temperature $T_2$. There are no fiber losses.

The heat balance equation may now be written:

$$m_k c_k T_1 + 100\left[\frac{\dot{m}_k}{k_1}\right] c\, T_2 + \dot{m}_h i'' = \dot{m}_k c_k T_2 + (100\left[\frac{\dot{m}_k}{k_1}\right] + \dot{m}_h)\, c\, T_2$$

Figure 4:
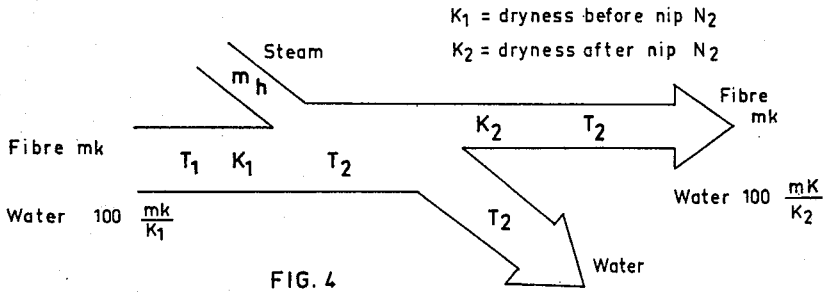
FIG. 4 is a diagram illustrating the heat economy of the invention.

(Symbols as in FIG. 4)

where $c_k$=specific heat capacity of the fiber
c=specific heat capacity of water
i''=enthalpy of the steam $$\frac{\dot{m}_h}{\dot{m}_k} = \frac{(T_2 - T_1)\, c_k + 100\, c/k_1)}{(i'' - c\, T_2)}$$

Since the final, completed paper contains about 7% water, the steam consumption per kg of paper is found to be ($\dot{m}_k$=0.93 $m_p$):

$$X = \frac{\dot{m}_h}{\dot{m}_p} = 0.93\,\frac{(T_2 - T_1)\,(c_k + 100\, c/k_1)}{(i'' - c\, T_2)}$$

Figure 7:
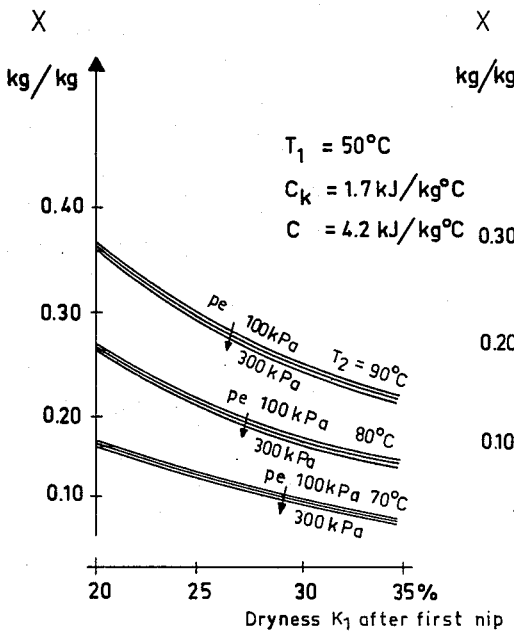
FIG. 7 is a graph illustrating the steam quantity required to raise the temperature of the web to a given value, plotted against the dryness which the web has reached after the first nip.
Figure 8:
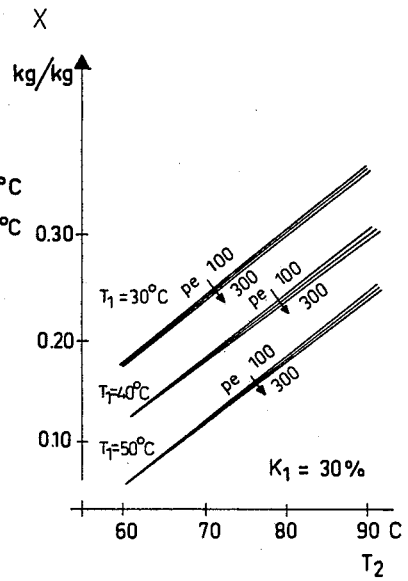
FIG. 8 is a graph illustrating the required steam quantity as a function of outgoing web temperatures.

FIGS. 7 and 8 present, in the form of a set of curves, the steam quantity X required for the treatment of the web W according to the invention, in dependence on the moisture content of the web when entering the treatment and the desired ultimate temperature $T_2$.

Scrutiny of FIGS. 7 and 8 reveals that the pressure $P_e$ of the saturated steam introduced in the box 60 is immaterial if only the steam supply pipe 62 and its supply holes 67 have been so dimensioned that the requisite flow from the pipe 62 is obtained.

EXAMPLE

In view of establishing the effect of the procedure and apparatus of the invention, the experiments reported in the following were carried out on the pilot paper machine at Rautpohja of the company Valmet Oy. The press section employed in the experiements was substantailly as presented in FIG. 1, except that the felt corresponding to the felt 1*b* of the suction roll 2*b* also operated as pickup felt, that is, there was no felt corresponding to that indicated with reference numeral 32 in FIG. 1.

For the experiments, a box substantially as in FIG. 2 was mounted adjacent to the suction zone of the suction roll 2*b* of the press section of the trial machine in the press between the first and second nips. Into this box saturated steam was conducted from a steam generator, and the following quantities were measured:

steam pressure
pulp stock temperature
temperature of the web
water content of the felts
dryness of the web.

The machine was run with speeds 10 and 13.5 m/s, and the most essential operating data were recorded. The paper stock consisted of conventional groundwood pulp.

Figure 5:
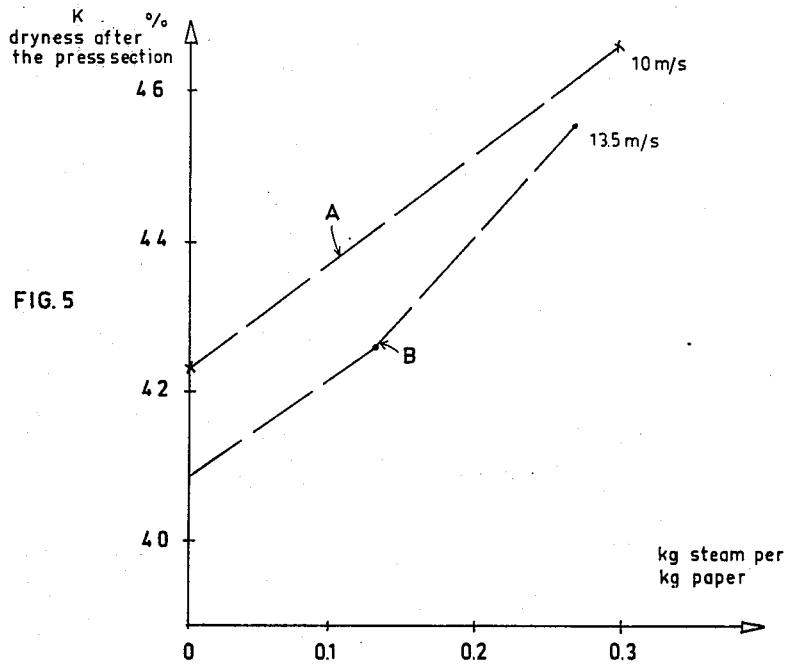
FIG. 5 is a graph illustrating the dryness of the paper web after the press section as a function of the quantity of steam supplied, at two different web speeds, the data illustrated therein having been recorded on a pilot paper machine fitted with equipment in accordance with the invention.

As regards the results obtained in the tests, reference is made to curves A and B in FIG. 5 (corresponding to web speeds 10 and 13.5 m/s, respectively), which show the dryness, in percent, of the web W after the press section, as a function of the quantity X of steam supplied according to the invention.

The observation can be made as a summary of the test results that when steam is blown onto the web W by the aid of a box mounted on the suction roll of the press section, the dryness of the paper web after the press section increases markedly:

| | |
|---|---|
| At speed v = 10 m/s | k = 42.2% rising to 46.5% |
| At speed v = 13.5 m/s | k = 40.8% rising to 45.3% |

The water content of the felts also went down somewhat when steam was used. The felts got warmer, but during the comparatively short trial run, the heat was not observed to have caused any damage to the felts.

The maximum steam consumption was 0.29 and 0.26 kg per kg of paper at the speed of 10 and 13.5 m/s, respectively. It may be mentioned for comparison that in the drying section of a newsprint machine, the normal consumption is 1.66 kg steam per kg of paper. It is thus understood that application of the procedure of the invention requires a considerable amount of steam, but in addition to the effect of improved runability of the paper machine, which is the object of the invention, the invention also results in a reduced steam consumption in the drying section because the web W is drier and warmer when it arrives in the drying section. It is well known that the heat output of the first drying cylinders is spent in raising the temperature of the web, while no evaporation takes place.

Closer details of the experiments which were carried out are apparent from the tables following below. The results of measurement are stated in Table I. Table II specifies the felts which were used in the experiements and Table III gives the removed water quantities, calculated from the results. From the data given therein it will be seen that subjecting the web to steam treatment increases the dry matter content by about 3 to 5% after the nip compared to normal processing without steam treatment.

TABLE I

| Running speed (m/s) | 10 | 13.5 |
|---|---|---|
| Loading (kN/M) (press pressures) | | |
| First nip | 60 | 60 |
| Second nip | 80 | 80 |
| Third nip | 90 | 90 |
| Degrees of vacuum (kPa) | | |
| Wire suction roll | 66.7 | 64.0 |
| Pickup | 26.7 | 28.0 |
| Press suction roll, first s. | 65.3 | 64.0 |

TABLE I-continued

| | | | | | |
|---|---|---|---|---|---|
| Press suction roll, second s. | 21.3 | | 22.7 | | |
| Press suction roll, third s. | 62.7 | | 62.7 | | |
| Steam supply overpressure (kPa) | 0 | 300 | 0 | 100 | 300 |
| Steam temperature (°C.) | — | 143 | — | 120 | 143 |
| Estimated steam quantity (g/s) | — | 102 | — | 53 | 102 |
| Base weight of paper (g/m²) | 55.3 | 57.9 | 48.7 | 48.7 | 48.7 |
| Dryness of paper, % | | | | | |
| After the wire | 19.5 | 19.2 | 18.3 | 16.9 | 16.9 |
| After the second nip | 35.8 | 39.0 | 34.2 | 35.4 | 36.9 |
| After the third nip | 42.4 | 46.5 | 40.8 | 42.6 | 45.3 |
| Temperature of the paper (°C.) | | | | | |
| After the second nip | 36.0 | 73.5 | 24.2 | 39.0 | 57.0 |
| After the third nip | | | 24.2 | 38.5 | 54.5 |
| Water in the pickup felt (g/m²) | 735 | 730 | 750 | | 730 |
| Water in the third felt (g/m²) (corresponds to felt 1d in (FIG. 1) | 550 | 510 | 525 | | 490 |

TABLE II

| | |
|---|---|
| Pickup | 1,084 g/m |
| Lower felt | 1,100 g/m |
| Third felt | 1,350 g/m |
| (All these felts are fully synthetic.) | |

TABLE III (Water removal quantities calculated from the results of measurement.)

| Speed (m/s) | 10 | | 13.5 | | |
|---|---|---|---|---|---|
| Supply steam overpressure (kPa) | 0 | 300 | 0 | 100 | 300 |
| Removed by third nip (g/m²) | 21.8 | 22.3 | 21.4 | 21.6 | 22.8 |
| Removed by 1st-2nd nip (g/m²) | 120 | 142 | 115 | 140 | 145 |
| Total | 142 | 165 | 137 | 162 | 168 |

It is seen on scrutiny of Tables I and III that the dewatering is enhanced in the second nip, whereas in the third nip, the increase of water removal capacity is minor. Since the pickup felt is heated, the dewatering is also improved in the first nip, although the steam supply box has no direct effect of the first nip.

On studying the test results, it is appropriate to point out to begin with that fully exact conclusions and calculations were somewhat impeded by the difficulties encountered in stabilizing various parameters, such as, e.g., the stock temperature, and by inaccuracies of measurement, e.g., of the steam quantity measurements, as well as by the fact that the whole steam quantity does not pass through the web W, but part of it discharges through the sides of the box.

At all events, it is positively observable from the test results that the steam blowing considerably improves the dryness of the web, and that it simultaneously increases the temperature of the web, which circumstances also contributes to higher drying capacity in the drying section, as was observed above.

The steam consumption of the box, per kg of paper, calculated from the estimates will be as follows:

| | | | |
|---|---|---|---|
| 1. | v = 10 m/s | $P_e$ = 300 kPa | x = 0.29 kg/kg |
| 2. | v = 13.5 m/s | $P_e$ = 300 kPa | x = 0.26 kg/kg |
| 3. | v = 13.5 m/s | $P_e$ = 100 kPa | x = 0.13 kg/kg |

If all steam were condensed in the paper, this would mean an increase of water content, per m², in the different cases:

1. 17.1 g $H_2O/m^2$
2. 12.7 g $H_2O/m^2$
3. 6.3 g $H_2O/m^2$ and this water mass adds to the amount that has to be removed in the second and third nips.

But it is noted that this complete condensation did not occur in the experiments because in that part of the steam spread into the environment, while part of it passes through the web and the felt into the suction roll.

Studies were also made concerning the changes in the quality characteristics of the paper which might be observable in connection with the experiments just described. This was done by analyzing specimens from consecutive runs with the steam supply disconnected in one run and connected in the other. It appears that the steam treatment of the web improves to some degree the opacity of the finished paper. This is indicated by the following figures relating to newsprint paper (57 g/m², consisting of 76% ground wood and 24% chemical pulp):

| | Steam Treated | Normal Paper |
|---|---|---|
| SCAN-OPACITY | 94.2% | 92.3% |

The above increase in opacity can be regarded as statistically significant.

Various details of the invention are not confined to what has been presented in the foregoing for illustration only. For instance, although in the foregoing first nip, etc., has been specified, this does not exclude the possibility that there are nips prior to this particular nip, such as, e.g., a pickup nip or another nip carrying out a preliminary pressing and dewatering operation.

While certain advantageous embodiments have been chosen to illustrate the invention, it will be understood by those skilled in the art that various changes and modifications can be made therein without departing from the scope of the invention as defined in the appended claims.

What is claimed is:

1. In an apparatus for dewatering a paper web in the press section of a paper machine of the type having a felted suction roll, at least one roll forming at least one nip with the suction roll, the web being passed around a sector of the suction roll, the improvement comprising steam supply means mounted adjacent said web, and means for conducting steam to said supply means, said supply means comprising at least one steam supply box extending across the entire width of said web adjacent the suction roll, said box having an interior space and an open side opening toward said suction roll and conforming to the curvature of said roll over a substantial sector thereof to define a flow path for treatment steam onto said sector;

an inner pipe in said steam box;

a shell portion; and means for supporting said shell portion around said inner pipe;

said shell portion comprising a concave wall adjacent said suction roll, said wall having means defining openings therethrough for the passage of steam, an inner wall defining, with said concave wall, a steam supply space, an outer wall spaced from said inner wall, thermal insulating means between said inner and outer walls, and means defining openings through a wall of said pipe for directing steam into said steam supply space in a direction away from the web, said supply box further comprising steam quantity adjustment means operatively associated with said openings through said wall of said pipe for controlling the flow of steam into said space, a plurality of said openings and associated adjustment means being disposed in side-by-side relationship along said pipe.

2. In an apparatus for dewatering a paper web in the press section of a paper machine of the type having a felted suction roll, a water-receiving roll forming a first nip with the suction roll and a plain roll forming a second nip with the suction roll, the web being passed around a sector of the suction roll successively between the first and second nips, the improvement comprising steam supply means mounted adjacent said web, and means for conducting steam to said supply means, said supply means comprising at least one steam supply box extending across the entire width of said web adjacent the suction roll, said box having an interior space and an open side opening toward said suction roll and conforming to the curvature of said roll over a substantial sector thereof to define a flow path for treatment steam onto said sector;

an inner pipe in said steam box;

a shell portion; and means for supporting said shell portion on said inner pipe;

said shell portion comprising a concave wall adjacent said suction roll, said wall having means defining openings therethrough for the passage of steam, an inner wall defining, with said concave wall, a steam supply space, an outer wall spaced from said inner wall, thermal insulating means between said inner and outer walls, and means defining openings through a wall of said pipe for directing steam into said steam supply space in a direction away from the web, said supply box further comprising steam quantity adjustment means operatively associated with said openings through said wall of said pipe for controlling the flow of steam into said space, a plurality of said openings and associated adjustment means being disposed in side-by-side relationship along said pipe.

3. An apparatus according to claim 2 wherein said supply box further comprises suction means at opposite ends of said box adjacent the lateral margins of said web for preventing the escape of steam to the sides thereof.

* * * * *